US008396355B2

(12) United States Patent
Jones

(10) Patent No.: US 8,396,355 B2
(45) Date of Patent: Mar. 12, 2013

(54) HEATER

(76) Inventor: David M. Jones, Crawley (GB)

( * ) Notice: Subject to any disclaimer, the term of this patent is extended or adjusted under 35 U.S.C. 154(b) by 806 days.

(21) Appl. No.: 11/918,058

(22) PCT Filed: Apr. 6, 2006

(86) PCT No.: PCT/GB2006/001270

§ 371 (c)(1),
(2), (4) Date: Jul. 23, 2009

(87) PCT Pub. No.: WO2006/106345

PCT Pub. Date: Oct. 12, 2006

(65) Prior Publication Data

US 2009/0297133 A1 Dec. 3, 2009

(30) Foreign Application Priority Data

Apr. 8, 2005 (GB) ..... 0507125.3

(51) Int. Cl.
*F21V 7/00* (2006.01)

(52) U.S. Cl. ..... 392/422; 392/407; 392/411; 392/419; 392/413

(58) Field of Classification Search ..... 392/407, 392/411, 413, 419, 422
See application file for complete search history.

(56) References Cited

U.S. PATENT DOCUMENTS

| | | | | | |
|---|---|---|---|---|---|
| 1,514,628 | A | * | 11/1924 | Pritzker | 219/455.12 |
| 1,686,865 | A | * | 10/1928 | Klotz | 392/423 |
| 2,879,369 | A | * | 3/1959 | Huseby | 392/430 |
| 3,141,089 | A | * | 7/1964 | Hultgreen | 392/423 |
| 3,179,789 | A | * | 4/1965 | Gialanella | 392/424 |
| 3,317,707 | A | * | 5/1967 | Knudson et al. | 392/353 |
| 3,363,090 | A | * | 1/1968 | Langley | 219/540 |
| 3,525,850 | A | * | 8/1970 | Hager, Jr. | 392/433 |
| 3,684,859 | A | * | 8/1972 | Desloge | 392/432 |
| 4,004,128 | A | * | 1/1977 | Marchesi | 392/407 |
| 4,319,125 | A | * | 3/1982 | Prince | 126/92 B |
| 4,331,878 | A | * | 5/1982 | Steinmetz | 250/504 R |
| 4,391,323 | A | * | 7/1983 | Schnier | 359/867 |
| 4,563,572 | A | * | 1/1986 | Hager, Jr. | 392/423 |
| 4,626,659 | A | * | 12/1986 | Charmes et al. | 392/408 |
| 4,703,154 | A | * | 10/1987 | Ikegami et al. | 392/435 |
| 4,727,854 | A | | 3/1988 | Johnson | |
| 4,835,367 | A | * | 5/1989 | Hoffman | 392/376 |
| 4,892,997 | A | * | 1/1990 | McWilliams | 219/448.11 |
| 5,049,725 | A | * | 9/1991 | Abramson | 392/412 |
| 5,296,686 | A | * | 3/1994 | Ullrich et al. | 219/553 |
| 5,561,735 | A | * | 10/1996 | Camm | 392/416 |
| 5,626,125 | A | * | 5/1997 | Eaves | 126/91 A |

(Continued)

FOREIGN PATENT DOCUMENTS

| | | |
|---|---|---|
| DE | 298 08 708 U1 | 9/1998 |
| GB | 2 145 218 A | 3/1985 |

OTHER PUBLICATIONS

International Search Report, Jul. 3, 2006.

*Primary Examiner* — Thor Campbell
(74) *Attorney, Agent, or Firm* — Blank Rome LLP

(57) ABSTRACT

A heater comprising a radiative heating element disposed beneath a housing, in a recess formed therein; the recess having a heat reflective surface for reflecting heat radiation from the radiative heating element in a downwards direction. A heat deflecting member is located between the heating element and the reflective surface of the housing to prevent heat emitted from heating element from directly reaching the reflective surface.

14 Claims, 6 Drawing Sheets

U.S. PATENT DOCUMENTS 5,761,377 A * 6/1998 Wolfe et al. ..... 392/376
6,138,662 A 10/2000 Jones
6,154,606 A * 11/2000 Shaw et al. ..... 392/360
6,188,047 B1 * 2/2001 White et al. ..... 219/460.1
6,188,836 B1 * 2/2001 Glucksman et al. ..... 392/376
6,286,500 B1 * 9/2001 Jones ..... 126/91 A
7,067,773 B2 * 6/2006 DeWitt ..... 219/451.1
7,254,319 B2 * 8/2007 Bonnin et al. ..... 392/423

* cited by examiner

HEATER

The present invention relates to a heater of the type in which a combustible substance is burnt to release heat. More particularly the invention relates to radiant heaters for heating industrial buildings such as factories, warehouses, hangers and other large structures.

It is known to heat large buildings, and in particular large industrial premises by means of radiant heaters, and typical radiant heaters used for this purpose consist of a U-tube radiator system, a burner such as a gas burner being connected to one end of the tube and a fan being arranged at the other end of the tube for extracting combustion gases from the tube. The U-tube is suspended below a heat reflective housing, which reflects radiation emitted from the tube towards the ground. Such a heater is disclosed in, for example, British Patent Application GB 2145218.

A major problem encountered with such radiant heaters lies in ensuring that the radiant flux density at ground level is as uniform as possible, and that hot spots and cold spots are avoided. This represents a problem because whilst a particular form of radiant heater may be configured to provide optimal heating in a building of one size and shape, it may provide a far from ideal heating effect when used in a building of a different size and shape. In particular, it has proved difficult to compensate for variations in the mounting height above ground level, the mounting height generally being dependent upon the availability of support structures such as roof support structures on which to mount the heaters.

The applicant's earlier U.S. Pat. No. 6,138,662 discloses a modular heating assembly comprising a basic heater unit to which may be attached a reflective skirt having any one of a plurality of reflector configurations. While the heater system disclosed has proved very successful improvements to the heater have been made to increase its output and overall efficiency.

The present invention therefore relates to an improved heater unit.

In a first aspect the invention provides a radiant heater comprising a radiative heating element; a housing, the underside of which is recessed to receive the radiative heating element, the radiative heating element being disposed beneath the housing such that its upper half is wholly within the recess, and at least a portion of its lower half protrudes downwardly from the recess; the recess having a heat reflective surface for reflecting heat radiation from the radiative heating element in a downwards direction and a heat deflecting member located between the heating element and the reflective surface of the housing so as prevent heat emitted from heating element from directly reaching the reflective surface.

Preferably, the heat deflecting member is located at least partially along the length of the heating element.

Preferably still two or more adjacent heat deflecting members extend along at least partially the length of the heating element.

Preferably, the heat deflecting member or members are attached to a bracket secured to a top surface of the heating element.

Preferably, the heat deflecting member or members extend above and to each side of the heating element.

Preferably, the housing further comprises a top cover suspended above the reflective surface.

Preferably still no insulation is provided between the top cover and the reflective surface.

One embodiment of the invention will now be illustrated, by way of example, by reference to the accompanying drawings in which.

Figure 1:
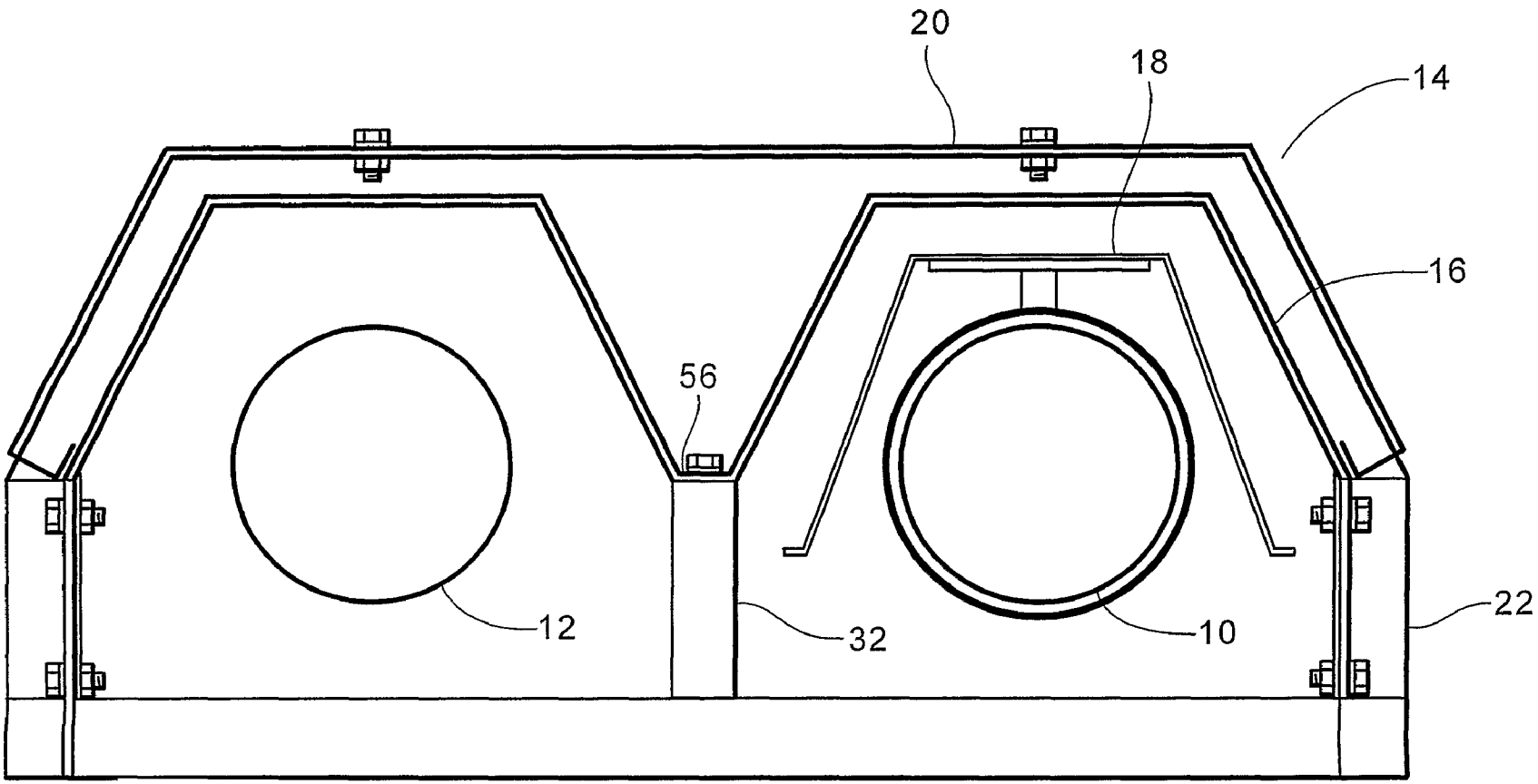
FIG. 1 is an sectional view of a heater unit constructed in accordance with one embodiment of the invention.

Referring first to FIG. 1, the radiant heater comprises two burner tubes 10, 12 located within a housing, generally designated 14. The housing 14 includes a reflector assembly 16, a deflector assembly 18 and a top cover assembly 20.

Figure 2:
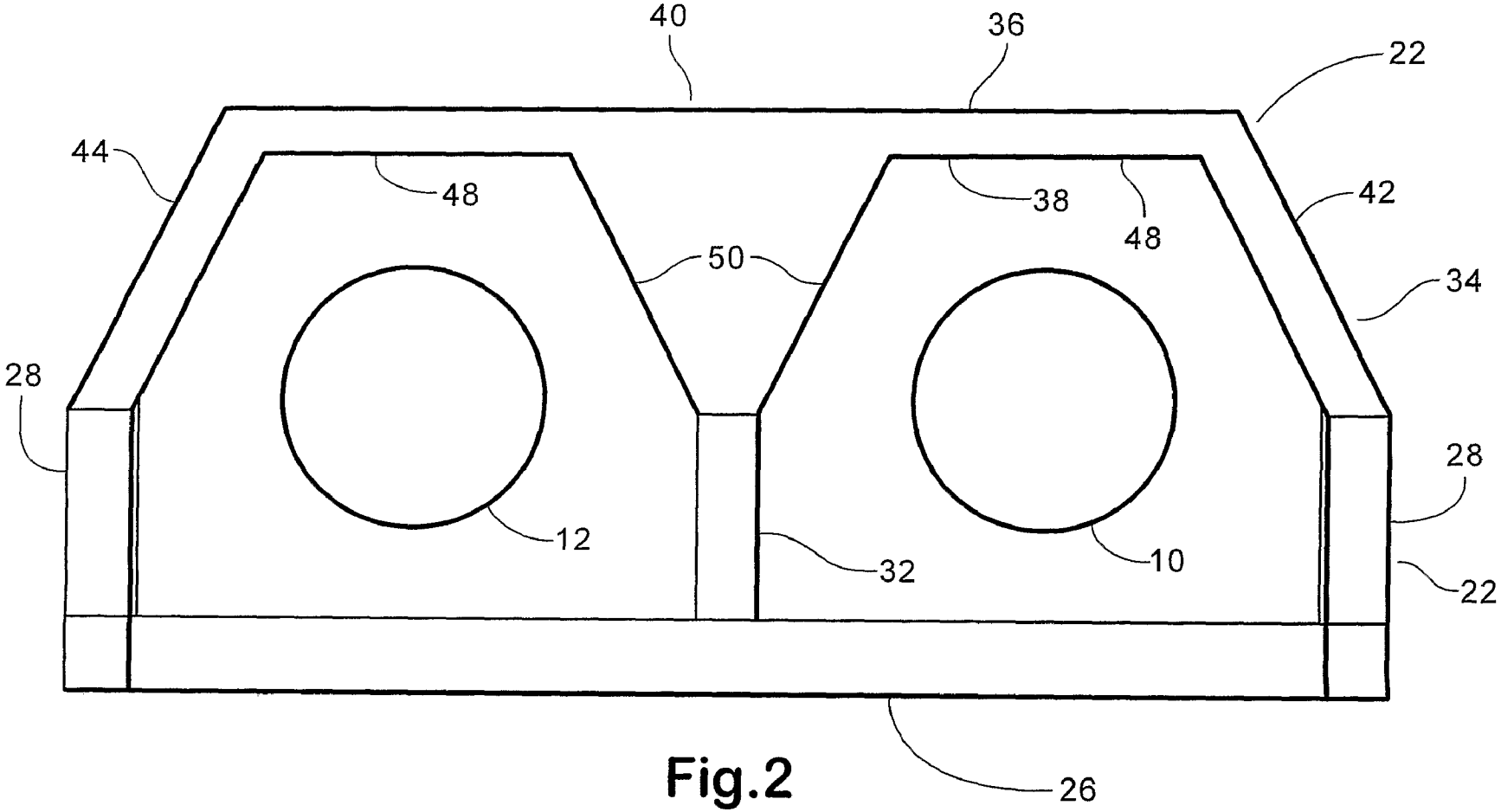
FIG. 2 is the view of FIG. 1 showing the bracket assembly.

A bracket assembly 22 is provided at spaced (e.g. one meter) intervals along the housing 14. Such a bracket assembly 22 is shown in FIG. 2.

The bracket assembly 22 comprises a lower bracket 24 which has a generally horizontal cross-bar portion 26 formed of box section steel and, secured thereto, by means of bolts (not shown), a generally upright member 28. At the midpoint of the cross-bar portion 30, is secured, by welding, a short transversally mounted piece of steel box section 32.

An upper bracket 34 has an outer wall 36 and an inner wall 38. The outer wall 36 is formed so as to have a generally horizontal region 40 and downwardly divergent portions 42 and 44. The ends of the divergent portions 42, 44 of the upper bracket 34 are secured to the upright members 28 of the lower bracket 24.

The inner wall 38 of the upper bracket 34 is shaped so as to have first and second horizontal regions 46, 48 divided by downwardly convergent members 50, the distal ends of which are secured to the steel box section 32 of the lower bracket 24.

Figure 3:
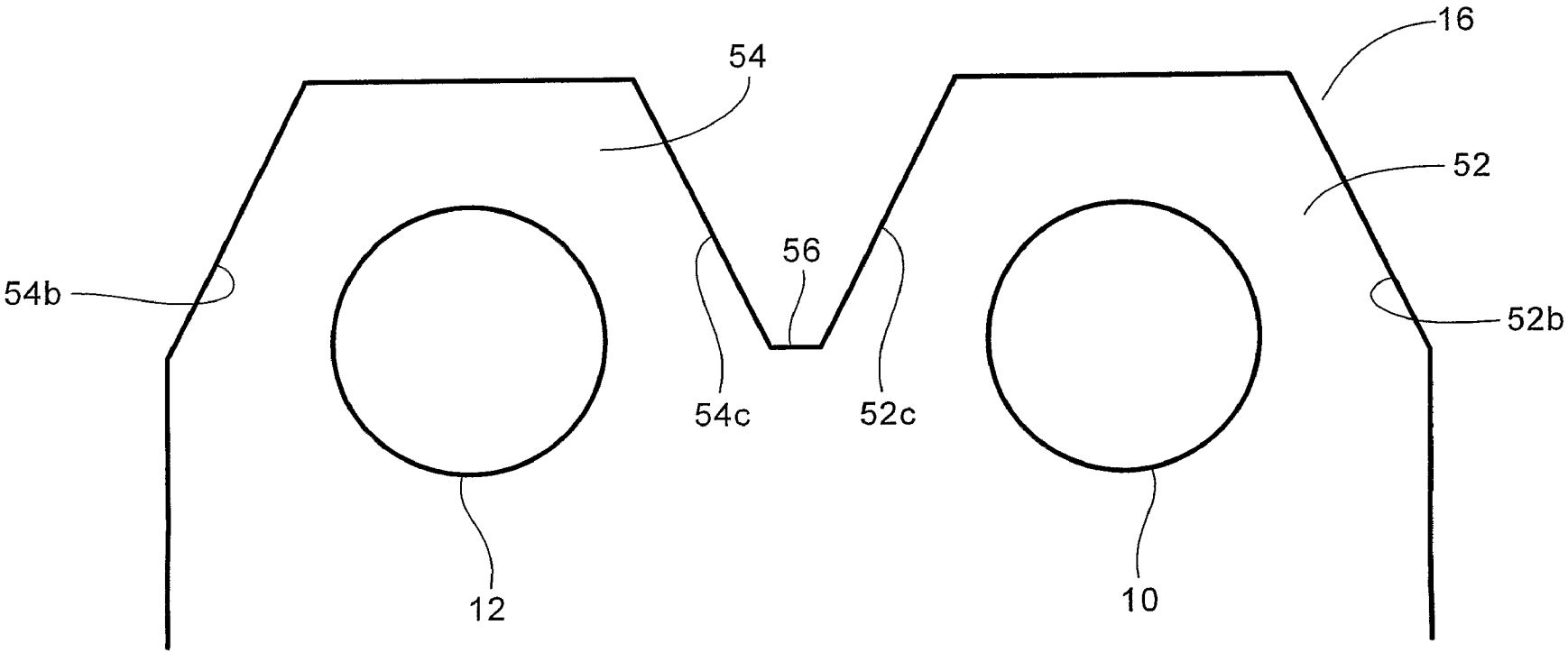
FIG. 3 is the view of FIG. 1 showing the reflector assembly.

The reflector assembly 16 is shown in FIG. 3. The reflector assembly 16 comprises a sheet of aluminium, the profile of which follows that of the inner wall 38 of the upper bracket 34. The reflector 16 is attached to the inner wall of the upright members 22 of the lower bracket and the top surface of the box section 32 via a nut and bolt, or similar, mechanism.

The reflector 16, once installed as part of the housing 10 therefore defines two downwardly open-sub channels 52, 54, each having an upper reflective surface 52*a*, 54*a* and downwardly divergent lateral reflective surfaces 52*b*, 52*c*, 54*b*, 54*c*. Surfaces 52*c* and 54*c* are linked together via a linking wall 56 which is bolted to the top surface of the box section 32.

Figure 4:
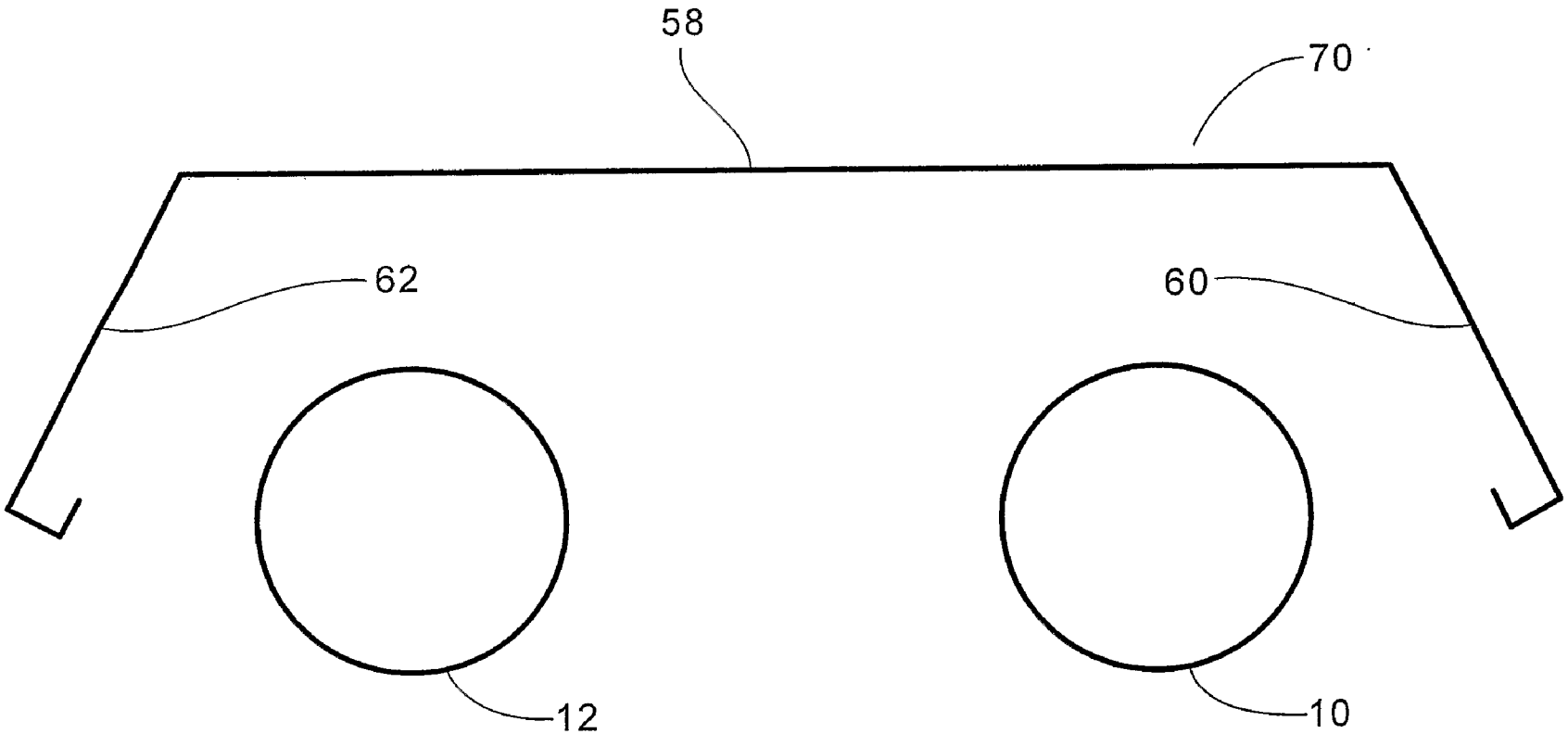
FIG. 4 is the view of FIG. 1 showing the top cover.

The top cover assembly 20 is shown in FIG. 4. The cover 20 comprises a sheet of mild steel which has a generally horizontal region 58 extending to downwardly divergent portions 60, 62. The cover 20 is bolted to the outer wall 36 of the upper bracket 34 so as to suspend approximately 1.5 to 2.5 cm above the reflector 16. No insulation is provided between the cover 20 and the reflector 16. As a result, the temperature of combustion air entering the burner is increased by absorbing additional heat from the entire top surface of the reflector 16 which, in turn substantially increases the flame temperature. This has the effect of markedly improving the output of the heater (by some 10 to 15%) and thus the efficiency and overall performance of the system as the total radiant heat output of a heater is proportionate to the overall temperature of the tubes 10, 12 within the system.

Figure 5:
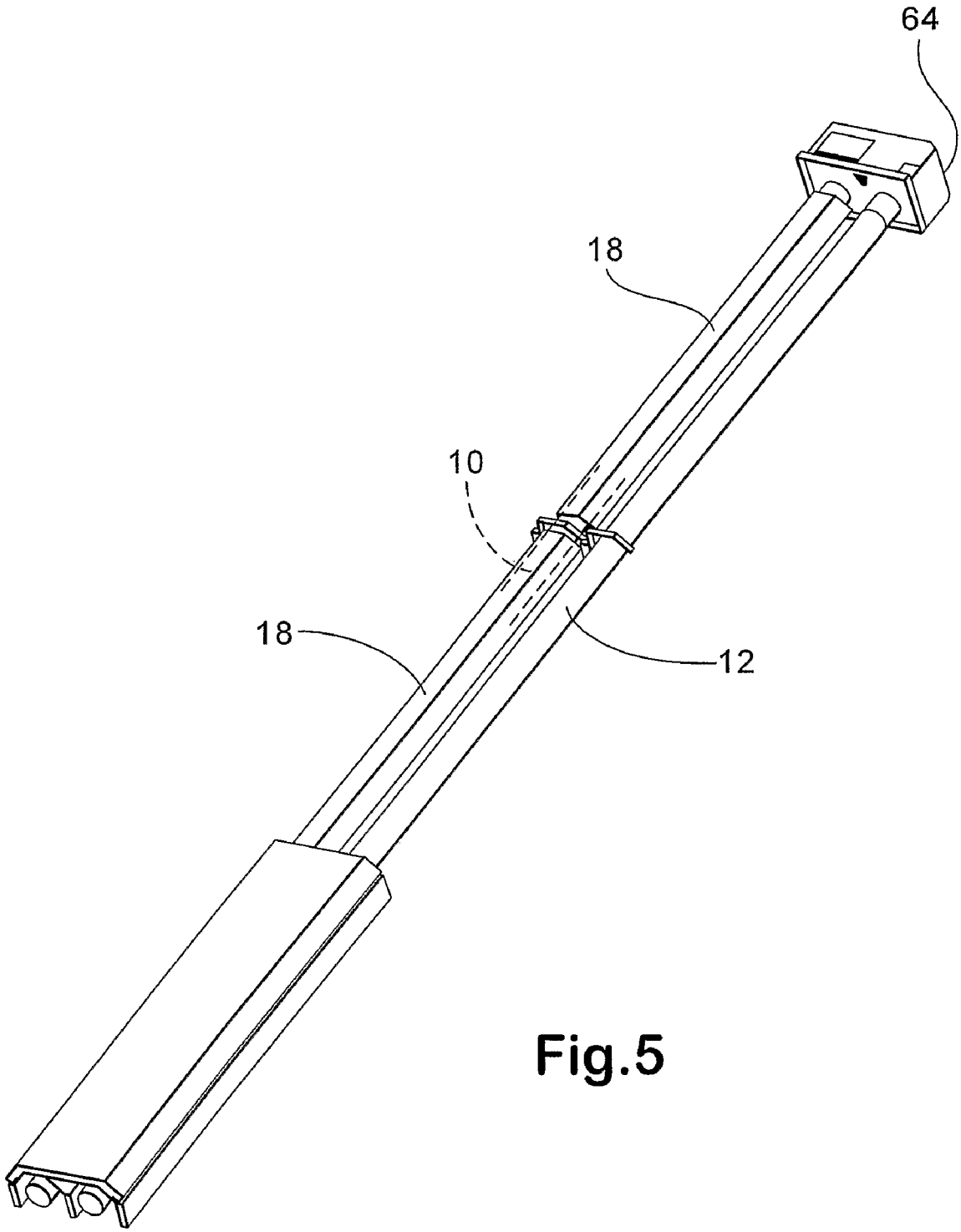
FIG. 5 is perspective view from above of the burner tubes of FIG. 1.

Referring now to FIG. 5, the burner tubes 10, 12 extend along the channels 52, 54 from one end of the housing 14 to the other. Tube 10 is connected at one end to a gas burner 64 which heats the interior of the tube 10. Combustion gases are drawn along the tube 10 from the burner 64 via a U-bend (not shown) and into the return tube 12 by means of an extraction fan (not shown) mounted at one end.

The tubes 10, 12 are formed from steel or the like, and may be surface treated to maximise their radiative efficiency. In use, the tube 10 is heated by means of the gas burner 64 and then functions as a radiator heating element. Tube 12 also gives out radiation, but to a lesser extent since the tube is somewhat cooler than tube 10.

In the present system, the heater operates at a higher temperature than can usually be expected in similar systems, such as that described in the Applicant's previous patents. A hot-spot, well in excess of 640° C., occurs along the tube 10 approximately 1.5 m from the burner 64 for a distance of approximately 1 m. The heat emitted at this hot-spot would ordinarily cause damage and distortion to the aluminium reflector 16 above the tube 10 in that region, particularly when the heater system is in operation for long periods.

To prevent such distortion, then housing 14 includes a deflector assembly 18 located above the tube 10 extending along the length of the hot-spot region.

Figure 6:
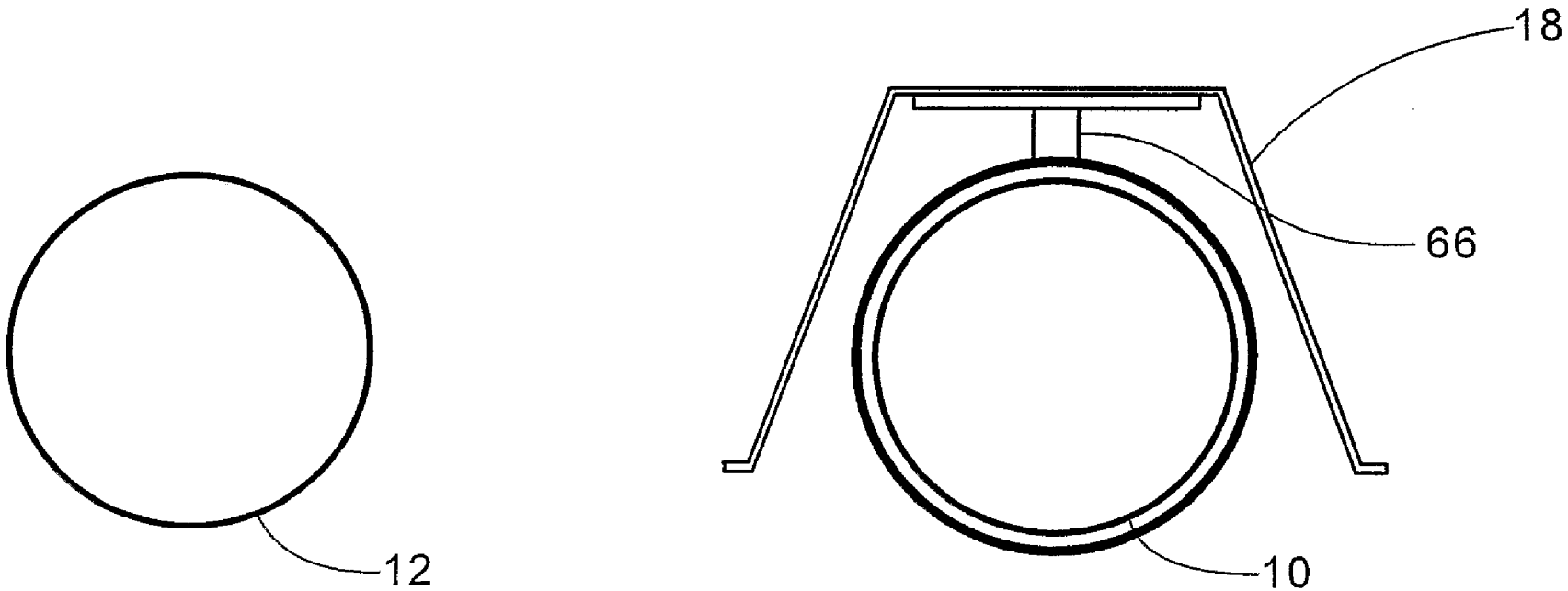
FIG. 6 is the view of FIG. 1 showing the deflector assembly.

The deflector assembly 18 is best shown in FIG. 6. Here, it can be seen that a "T-shaped" mounting bracket 66 is secured to the top side of the tube 10 to extend upwardly therefrom. Several mounting brackets 66 are located at spaced intervals along the tube in the hot-spot region to allow a stainless steel deflector 18 to extend along the tube 10 across the hot-spot region. As can be seen in FIG. 5, the deflector 18 comprises two adjacent heat dissipation profiled panels of stainless steel, each of around 2.2 m in length.

The deflectors 18 act to absorb and dissipate the radiant heat emitted from the tube 10, and particularly its top surface, over the hot-spot region to deflect the radiant heat from reflector 16 in that region, thus preventing the intense heat from directly reaching the reflector 16. The deflectors 18 are profiled so as to have a generally horizontal top surface 68 (to cover the top surface of the tube 10) and two divergent downwardly extending surfaces (to cover the side surfaces of the tube 10 thereby to prevent intense radiant heat from directly reaching the adjacent cooler tube 12 and the reflector linking wall 56.

The presence of the deflector assembly 18 has been found to increase the overall efficiency of the heating system whilst preventing damage and distortion to parts of the housing 14.

The tubes 10, 12 are supported within the housing by tube-supporting cables as detailed in Applicants earlier U.S. Pat. No. 6,138,662 which is incorporated herein by reference.

It will readily be apparent that numerous modifications and alterations may be made to the radiant heaters illustrated in the drawings and described above, without departing from the principles underlying the present invention, and all such modifications and alterations are intended to be embraced by this application.

The invention claimed is:

1. A radiant heater comprising:

a radiative heating element;

a housing, the underside of which is recessed to receive the radiative heating element, the radiative heating element being disposed beneath the housing such that its upper half is wholly within the recess, and at least a portion of its lower half protrudes downwardly from the recess the recess having a heat reflective surface for reflecting heat radiation from the radiative heating element in a downwards direction; and a heat deflecting member located between the heating element and the reflective surface of the housing, wherein the heat deflecting member extends at least partially along a length of the heating element, and wherein the heat deflecting member is configured to absorb and dissipate radiant heat emitted from the heating element so as prevent heat emitted from the heating element from directly reaching the reflective surface.

2. A radiant heater according to claim 1 wherein two or more adjacent heat deflecting members extend at least partially along the length of the heating element.

3. A radiant heater according to claim 1, wherein the heat deflecting member is attached to a bracket secured to a top surface of the heating element.

4. A radiant heater according to claim 1, wherein the heat deflecting member extends above and to each side of the heating element.

5. A radiant heater according to claim 1, wherein the housing further comprises a top cover suspended above the reflective surface.

6. A radiant heater according to claim 5, wherein no insulation is provided between the top cover and the reflective surface.

7. A radiant heater according to claim 3, wherein the bracket is a "T-shaped" bracket extending upwardly from the top surface of the heating element.

8. A radiant heater according to claim 3, wherein the heat deflecting member is attached to a plurality of brackets secured to a top surface of the heating element, the plurality of brackets disposed at spaced intervals along the heating element.

9. A radiant heater according to claim 4, wherein the heat deflecting member includes a horizontal top surface configured to cover a top surface of the heating element, and two downwardly extending surfaces configured to cover side surfaces of the heating element.

10. A radiant heater according to claim 1, wherein the heat deflecting member extends along a portion of the heating element approximately 1.5 m from an end of the heating element.

11. A radiant heater according to claim 1, wherein the heat deflecting member has a length of at least 1 m.

12. A radiant heater according to claim 1, wherein the heat deflecting member has a length of approximately 2.2 m.

13. A radiant heater according to claim 1, wherein the heat deflecting member comprises stainless steel.

14. A radiant heater according to claim 1, wherein the heating element is supported within the housing by at least one cable.

* * * * *